US006489281B1

(12) United States Patent
Smith et al.

(10) Patent No.: US 6,489,281 B1
(45) Date of Patent: Dec. 3, 2002

(54) CLEANING COMPOSITION COMPRISING INORGANIC ACIDS, AN OXIDANT, AND A CATIONIC SURFACTANT

(75) Inventors: Kim R. Smith, Woodbury, MN (US); Robert D. P. Hei, Baldwin, MN (US); Michael E. Besse, Golden Valley, MN (US); Jerry D. Hoyt, Hastings, MN (US)

(73) Assignee: Ecolab Inc., St. Paul, MN (US)

( * ) Notice: Subject to any disclaimer, the term of this patent is extended or adjusted under 35 U.S.C. 154(b) by 29 days.

(21) Appl. No.: 09/659,795

(22) Filed: Sep. 12, 2000

(51) Int. Cl.[7] ..... C11D 7/08; C11D 7/18; C11D 1/62

(52) U.S. Cl. ..... 510/254; 510/245; 510/253; 510/269; 510/367; 510/372; 510/375; 510/379; 510/380; 510/384; 510/391; 510/504

(58) Field of Search ..... 510/245, 253, 510/254, 269, 367, 372, 375, 379, 380, 384, 391, 304

(56) References Cited

U.S. PATENT DOCUMENTS

| | | | | |
|---|---|---|---|---|
| 2,765,216 | A | | 10/1956 | Heiderich |
| 2,834,659 | A | | 5/1958 | Mathre et al. |
| 3,036,887 | A | | 5/1962 | Beer et al. |
| 3,085,856 | A | | 4/1963 | Lake et al. |
| 3,645,790 | A | * | 2/1972 | Burden et al. ..... 134/3 |
| 3,692,583 | A | | 9/1972 | Mucenieks et al. |
| 3,988,254 | A | | 10/1976 | Mori |
| 3,988,256 | A | | 10/1976 | Vandermey et al. |
| 4,270,957 | A | | 6/1981 | Donakowski et al. |
| RE31,395 | E | | 9/1983 | Rooney |
| 4,435,223 | A | * | 3/1984 | Dollman ..... 134/3 |
| 4,477,290 | A | | 10/1984 | Carroll et al. |
| 4,793,903 | A | | 12/1988 | Holmquist et al. |
| 4,851,148 | A | | 7/1989 | Yamasoe et al. |
| 4,857,225 | A | * | 8/1989 | Terada et al. ..... 252/100 |
| 4,883,541 | A | | 11/1989 | Tadros |
| 4,888,090 | A | | 12/1989 | Sheetz |
| 4,959,105 | A | | 9/1990 | Neidiffer et al. |
| 4,980,076 | A | | 12/1990 | Tanaka et al. |
| 5,122,538 | A | | 6/1992 | Lokkesmoe et al. |
| 5,198,085 | A | | 3/1993 | Vaughan |
| 5,227,016 | A | | 7/1993 | Carlson et al. |
| 5,248,399 | A | | 9/1993 | Meguro et al. |
| 5,336,425 | A | | 8/1994 | Aoki et al. |
| 5,382,295 | A | | 1/1995 | Aoki et al. |
| 5,391,234 | A | | 2/1995 | Murphy |
| 5,464,484 | A | | 11/1995 | Rodzewich |
| 5,514,293 | A | | 5/1996 | Shimakura et al. |
| 5,538,561 | A | | 7/1996 | Brown et al. |
| 5,545,347 | A | | 8/1996 | Ouyang et al. |
| 5,669,980 | A | | 9/1997 | McNeil et al. |
| 5,688,755 | A | | 11/1997 | Ikeda et al. |
| 5,762,819 | A | | 6/1998 | Franck et al. |
| 5,932,020 | A | | 8/1999 | Murphy |

OTHER PUBLICATIONS

Chemical Abstract, Phosphoroperoxoic acid (6CI, 7CI), 13598–52–2 Registry (date unknown).

Meadow, M. et al., Abstract, Eur. Pat. No. 527537, "Purification of aqueous peroxy acids and peroxy salt solutions," Eur. Pat. Appl., 11 pp. (1995).

Afzal, S. M., "Preparation and estimation of peracids and peroxides," Pak. J. Sci., Abstract, 32(3–4), 201–4 (1980).

Muratbekov, M. B. et al., "Radiation–induced oxidation of hypophosphorous and phosphorous acids in a phosphoric acid medium," Khim. Vys. Energ., Abstract, 13(2), 179–81 (1979).

Miller, N. B. et al., "Effect of temperature and potential on the synthesis of peroxyphosphates," Elektrokhimiya, Abstract, 13(3), 424–7 (1977).

Taketa, T. et al., Abstract, JP Pat. No. 11158691, "Aqueous solutions and manufacture of titanium oxide films using them by electrolysis deposition," Jpn. Kokai Tokkyo Koho, 5 pp. (1999).

Goffinet, P. et al., Abstract, FR. Pat. No. 2766724, "Nonaggressive decontaminating compositions," Fr. Demande, 20 pp. (1999).

Takeda, T. et al., Abstract, JP Pat. No. 11071698, "Solution for electrodeposition of bismuth oxide with high crystallinity and uniform composition," Jpn. Kokai Tokkyo Koho, 4 pp. (1999).

Goffinet, P. et al., Abstract, Eur. Pat. No. 894512, "Use of stabilized decontaminating compositions for the decontamination of toxic agents and/or pollutants," Eur. Pat. Appl., 20 pp. (1999).

Williams, D. R., et al., Abstract, U.S. Pat. No. 5814303, "Dentifrice and dispenser therefore," U.S., 6 pp. (1998).

Ikeda, K. et al., Abstract, JP Pat. No. 10192813, "Method for stabilization of heavy metals in waste solids using treatment agents," Jpn. Kokai Tokkyo Koho, 7 pp. (1998).

Springer, E. L., "Delignification of aspen wood and pine kraft pulp with peroxymonophoshporic acid," Int. Pulp Bleaching Conf., Abstract, vol. 2, 391–396 Publisher: TAPPI Press, Atlanta, GA (1996).

Springer, E. L., "Delignification of wood and kraft pulp with peroxymonophosphoric acid," J. Pulp Pap. Sci., Abstract, 23(12), J582–J584 (1997).

(List continued on next page.)

*Primary Examiner*—Charles Boyer
(74) *Attorney, Agent, or Firm*—Merchant & Gould P.C.

(57) ABSTRACT

A cleaning composition is provided according to the invention. The cleaning composition includes a product of mixing an acid component, a source of phosphoric acid component, and an oxidant component. The molar ratio of oxidant component to phosphoric acid component is preferably between about 2:1 and about 1:2, and the molar ratio of oxidant component to acid component is preferably between about 1:3 and about 1:5. A method of cleaning an aluminum surface is provided. The method includes a step of applying the cleaning composition to an aluminum surface, and rinsing the cleaning composition from the aluminum surface.

30 Claims, No Drawings

OTHER PUBLICATIONS

Henriet, D., Abstract, U.S. Pat. No. 5690748, "Acidic redox bath with ferric ions for pickling of stainless steel surface," U.S., 4 pp. Cont. of U.S. Ser. No. 840,183, abandoned (1997).

Lion, C. et al., "Novel decontamination agents. Destruction of organophosphorus and sulfur toxic agents by monoperoxyphosphoric acid," Phosphorus, Sulfur Silicon Relat. Elem., Abstract, 118, 89–94 (1996).

Miracle, G. S. et al., Abstract, U.S. Pat. No. 5576282, "Color–safe imine bleach boosters, compositions and laundry methods employing same," U.S., 22 pp. (1996).

Springer, E. L., Abstract, U.S. Pat No. 5529663, "Delignification of lignocellulosic materials with peroxymonophosphoric acid," U.S., 15 pp. (1996).

Inoe, K. et al., Abstract, JP Pat. No. 06145120, "Preparation of ammonium salts of iron (III)—polyaminocarboxylate complexes," Jpn. Kokai Tokkyo Koho, 5 pp. (1994).

Lee, C. L. et al., Abstract, PCT Pat. No. WO9213993, "Bleaching of chemical pulps by in–situ generated dioxirane," PCT Int. Appl., 44 pp. (1992).

Brink, G. et al., Abstract, Ger. Pat. No. DE4040959, "Aqueous plastic dispersions with low formaldehyde contents," Ger., 6 pp. (1992).

Henriet, D. et al., Abstract, Eur. Pat. No. EP442775, "Pickling of steels and stainless steels," Eur. Pat. Appl., 4 pp. (1995).

Sedlak, R. P., Abstract, U.S. Pat. No. 4956035, "Composition and process for promoting adhesion on metal surfaces, especially of photoresists on copper for printed circuits," U.S., 4 pp. (1990).

Kitayama, M. et al., Abstract, Jpn. Pat. No. 01213372, "Coatings containing nonmetallic antifouling agent–releasable compounds," Jpn. Kokai Tokkyo Koho, 6 pp. (1989).

Lottermoser, M., Abstract, Ger. Pat. No. DE3304379, "Epoxy phosphoric acid adducts," Ger. Offen., 11 pp. Addn. to Ger. Offen. 3,208,748 (1984).

Abstract, Jpn. Pat. No. 58196297, "Cleaning agents for bath heaters," Jpn. Kokai Tokkyo Koho, 7 pp. (1983).

Hirai, Y. et al., Abstract, Jpn. Pat. No. 52112680, "Polymerization catalysts for vinyl compounds," Japan. Kokai, 3 pp. (1977).

Rawat, N. S., Abstract, "Determination of total sulfur in some Indian coals by oxidizing acid mixture of potassium permanganate and peroxymonophosphoric acid," Chem. Ind. (London), (17), 743–4 (1976).

Peng, P. H., Abstract, U.S. Pat. No. 5683670, "Method for increasing the production capacity of sulfuric acid plants and processes; removal of sulfur dioxide from sulfur trioxide," (source not listed) (1997).

Peng, P. H., Abstract, U.S. Pat. No. 5593652, "Method for Increasing the production capacity of sulfuric acid plants and processes; oxidation of sulfurous acid to sulfuric acid which decreases sulfur dioxide emissions," (source not listed) (1997).

Springer, E. L., Abstract, U.S. Pat. No. 5529663, "Delignification of lignocellulosic materials with peroxymonophosphoric acid; oxidation of lignocellulose material with peroxymonophosphoric acid to fragment lignin and form solid lignocellulose residue, separating residue and extracting with dilute alkaline solution; bleaching," (source not listed) (1996).

Davenport, K. A. et al., Abstract, U.S. Pat. No. 4803097, "Metal plating of plastic materials; preconditioning with ozone, base and oxidizer," (source not listed) (1989).

Machin, D. et al., Abstract, U.S. Pat. No. 4666622, "Stable thickened low Ph liquid bleaching compositions containing inorganic peroxy compounds; thickening surfactant, peroxy compound, acid and electrolyte sale," (source not listed) (1987).

Petrovich, V., Abstract, U.S. Pat. No. 3923647, "Froth flotation method for recovery of minerals; treatment with inorganic peroxy acids or salts," (source not listed) (1975).

Lottermose, M., Abstract, Ger. Pat. No. DE3400055, "Prodn. of mixed phosphate ester(s) of unsaturated cpds.—by reaction with peroxide(s), phosphorus pent oxide or peroxo mono phosphoric acid," (source not listed) (1985).

Abstract, Jpn. Pat. No. 54021421, "Gelation inhibitor for inorganic binders e.g. silicate—prepd. by mixing phosphorus acid and salt with water–soluble organic amine," (source not listed) (1979).

* cited by examiner

CLEANING COMPOSITION COMPRISING INORGANIC ACIDS, AN OXIDANT, AND A CATIONIC SURFACTANT

FIELD OF THE INVENTION

The invention relates to cleaning compositions, methods for manufacturing a cleaning composition, and methods for using a cleaning composition to clean and brighten an aluminum surface.

BACKGROUND OF THE INVENTION

Many vehicle washing compositions include hydrofluoric acid as a cleaning and polishing agent. Hydrofluoric acid works well for cleaning and polishing aluminum. Cleaning compositions containing hydrofluoric acid are used in commercial automobile and/or truck washing facilities. The presence of hydrofluoric acid in a cleaning composition presents a health hazard.

A composition for use on aluminum, which includes hydrofluoric acid, is described by U.S. Pat. No. 3,988,254 to Mori. Cleaning compositions for use on aluminum which have been developed as replacements for compositions containing hydrofluoric acid are described by U.S. Patent Nos. 5,248,399 to Meguro, et al.; U.S. Pat. No. 5,336,425 to Aoki, et al.; U.S. Pat. No. 5,382,295 to Aoki, et al.; U.S. Pat. No. 5,464,484 to Rodzewich; and U.S. Pat. No. 5,514,293 to Shimakura, et al.

SUMMARY OF THE INVENTION

A cleaning composition is provided according to the invention. The cleaning composition includes a product of mixing an acid component having a first $pk_a$ of about 2.5 or less and being less oxidizing than nitric acid, a source of phosphoric acid component to provide phosphoric acid, and an oxidant component. The molar ratio of oxidant component to phosphoric acid component is preferably between about 2:1 and about 1:2, and the molar ratio of oxidant component to acid component is preferably between about 1:3 and about 1:5.

A method of cleaning an aluminum surface is provided. The method includes a step of applying the cleaning composition to an aluminum surface, and rinsing the cleaning composition from the aluminum surface.

A method for manufacturing a cleaning composition is provided. The method includes a step of mixing an acid component having a first $pK_a$ of about 2.5 or less and being less oxidizing than nitric acid, a source of phosphoric acid component to provide phosphoric acid, and an oxidant component.

DETAILED DESCRIPTION OF THE INVENTION

The cleaning composition according to the invention can be used to clean and brighten aluminum surfaces. The cleaning composition is particularly useful for cleaning aluminum surfaces provided on the exterior of motor vehicles such as automobiles, pick-up trucks, trucks, and trailers. Because of its effectiveness in brightening aluminum surfaces, the cleaning composition according to the invention can be referred to as a brightening composition.

The cleaning composition can be made available as a concentrate or as a use solution. The concentrate can be made available as a composition containing or not containing water. The use solution is preferably obtained from the concentrate by adding water to the concentrate. In general, it is expected that the cleaning composition will be transported as a concentrate and then diluted at the use location to provide a use solution. Preferably, the use solution will contain between about 0.1 wt. % and about 20 wt. % cleaning components, and more preferably between about 1 wt. % and about 5 wt. % of cleaning components. It should be understand that the term "cleaning components" refers to the non-water portion of the cleaning composition that is responsible for providing the cleaning and brightening properties.

The cleaning composition comprises a product of mixing an acid component having a first $pk_a$ of about 2.5 or less and being less oxidizing than nitric acid, a source of phosphoric acid component, and an oxidant component. The cleaning composition preferably includes a molar ratio of oxidant component to phosphoric acid of between about 2:1 and about 1:2, and a molar ratio of oxidant component or phosphoric acid to acid component of between about 1:3 and about 1:5. Preferably, the molar ratio of oxidant component to phosphoric acid is about 1:1.

The acid component having a first $pk_a$ of about 2.5 or less and being less oxidizing than nitric acid that can be used according to the invention includes acids that are generally considered strong and non-oxidizing acids. The acid component, if it is oxidizing at all, is less oxidizing than nitric acid. Preferably, the acid component excludes nitric acid. The level of oxidization exhibited by an acid is reported in Lang's *Handbook of Chemistry*, 13th Ed., McGraw-Hill Book Company. Exemplary acids that can be used according to the invention include sulfuric acid, phosphoric acid, polyphosphoric acid, hydrochloric acid, hydrobromic acid, hydroiodic acid, imidiphosphoric acid, thiocyanic acid, and mixtures thereof The acid component can include a mixture of two or more acids having a first $pk_a$ of about 2.5 or less and being less oxidizing than nitric acid.

The source of phosphoric acid component that can be used according to the invention includes any component that generates phosphoric acid when added to water. Exemplary sources of phosphoric acid include phosphoric acid, polyphosphoric acid, and oxides of phosphorus. Exemplary oxides of phosphorus include phosphorus tetraoxide, phosphorus hexaoxide, and phosphorus decaoxide. A preferred source of phosphoric acid is phosphoric acid. The source of phosphoric acid component can include a mixture of two or more sources of phosphoric acid.

The oxidant component that can be used according to the invention includes those oxidants which exhibit an oxidation-reduction potential of greater than 0 volts, preferably greater than 0.5 volts, and even more preferably greater than 1.00 volts when measured as half-reactions at 25° C. as reported in *Lange's Handbook of Chemistry*, 13th ed., McGraw-Hill Book Company. Exemplary oxidants that can be used according to the invention include peroxygen compounds, ozone, halogens and their oxides, manganese compounds, chromium compounds, cerium compounds, vanadium compounds, copper compounds, silver compounds, iron compounds, titanium compounds, and mixtures thereof. Examples of peroxygen compounds include hydrogen peroxide, physical adducts of hydrogen peroxide, peroxycarboxylic acids and their salts and esters, peroxysulfuric acids and their salts and esters, peroxyphosphoric acids and their salts and esters, perborates, pertungstic acid, and permanganates. Examples of physical adducts of hydrogen peroxide include sodium percarbonate and urea peroxide. Examples of peroxycarboxylic acids include performic, peracetic, peroctanoic, 2-ethylhexanoic, and ocatdecanoic. Examples of peroxysulfuric acids include monoperoxysulfuric acid, diperoxysulfuric acid, dodecylbenzenepersulfonic acid, and octylpersulfonic acid. Examples of perborates include alkali metal salts such as sodium or lithium perborate and also perboric acid.

Examples of permanganates include alkali metal salts such as sodium or potassium permanganate and also permanganic acid. An exemplary manganese compound includes manganese dioxide. Exemplary halogen compounds include chlorine, bromine, iodine, and their interhalogen compounds; chlorate, bromate, and iodate salts; chorine dioxide and bromine dioxide; chloric, bromic, and iodic acids and their salts; perchloric, perbromic, and periodic acids and their salts; quaternary ammonium/phosphonium/sulfonium polyhalides such as choline diiodochloride, tetramethylammonium tribromide, hexadecyltrimethylphosphonium dibromochloride, and octyltrimethylsulfonium dichlorobromide; inorganic polyhalides such as potassium tribromide, sodium dibromochloride, and lithium dichloroiodide. Exemplary chromium compounds include chromic acid and its alkali and metal salts. Exemplary cerium compounds include cerium (IV) salts such as $CeO_2$ or $Ce(OH)_4$. Exemplary vanadium compounds include vanadium (III or higher) salts such as $VCl_3$ and $V_2O_5$. Exemplary silver compounds include silver (I) systems such as AgO. Exemplary iron compounds include iron (III) salts such as $Fe_2O_3$ or $FeCl_3$. Exemplary titanium compounds include titanium (IV) salts such as $TiO_2$ or $TiI_4$. Hydrogen peroxide is a preferred oxidant according to the invention. The oxidant component can include a mixture of oxidants which provide a summation oxidation-reduction potential greater than 0 volts, more preferably greater than 0.5 volts, and more even more preferably greater than 1.00 volts.

The cleaning composition can be referred to as a "product of mixing" because it is believed that the components of the cleaning composition react. It is believed that it is desirable for the oxidant component to react with the phosphoric acid component, and for the acid component to promote the reaction between the oxidant component and the phosphoric acid component. Furthermore, it is believed that a reaction between the acid component and the oxidant component may occur. Preferably, the reaction between the acid component and the oxidant component, if it occurs at all, is disfavored relative to the reaction between the oxidant component and the phosphoric acid component. Because it is not necessarily clear what exact chemical components are present in the cleaning composition, it is believed appropriate to refer to the composition as a product of mixing.

The cleaning composition is preferably used at a temperature that is less than about 80° C., and more preferably less than about 50° C. It is expected the cleaning composition will be used at about ambient temperature.

The cleaning composition provides a use solution that is generally considered non-alkaline. Alkaline cleaners having a pH greater than 7 or 8 have a tendency to remove aluminum. Preferably, the use solution according to the invention has a pH of less than 7, more preferably less than 5, and even more preferably less than 3.

Aluminum surfaces are generally considered to be very hydrophobic. Furthermore, dirty aluminum surfaces are generally believed to be even more hydrophobic. The mixture of acid component, source of phosphoric acid component, and oxidant component are generally considered to exhibit hydrophilic properties. In order for the cleaning composition to clean and brighten the aluminum surface, it is desirable to have the cleaning composition penetrate to the aluminum surface to provide cleaning and brightening of the aluminum surface. The hydrophobicity of the aluminum surface discourages penetration of the cleaning composition to the aluminum surface. Accordingly, it is desirable for the cleaning composition to include a penetrant to help the cleaning composition wet the aluminum surface and thereby effect cleaning and brightening of the aluminum surface.

Preferred penetrants that can be used according to the invention include relatively hydrophobic surfactants. In general, it is believed that hydrophobic surfactants are desirable because they allow the brightening agent to penetrate to the aluminum surface. In general, the following classes of surfactants are preferred in the following order: cationic surfactants, amphoteric surfactants and anionic surfactants, and nonionic surfactants.

Cationic surfactants that can be used according to the invention as penetrants include those surfactants having the formula:

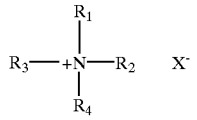

wherein each of $R_1$, $R_2$, $R_3$, and $R_4$ include, individually or in combination, substituents including 6 to 24 carbon atoms, preferably 14 to 24 carbon atoms, and more preferably, 16 to 24 carbon atoms. Each of $R_1$ to $R_4$ can be linear, cyclic, branched, saturated, or unsaturated, and can include heteroatoms such as oxygen, phosphorous, sulfur, or nitrogen. Any two of $R_1$ to $R_4$ can form a cyclic group. Any one of three of $R_1$ to $R_4$ can be hydrogen. X is preferably a counter ion and preferably a non-fluoride counter ion. Exemplary counter ions include chloride, bromide, methosulfate, ethosulfate, sulfate, and phosphate. Preferred cationic surfactants include quaternary ammonium salts such as trialkylbenzyl quaternary ammonium salt, tetraalkyl quaternary ammonium salt, and pyridinium quaternary ammonium salt. A preferred cationic surfactant includes tetradecyl dimethylbenzyl ammonium chloride.

A preferred type of cationic surfactant includes imidazolines and more preferably alkyl imidazoline quaternary ammonium salts, wherein the alkyl group contains 6 to 24 carbon atoms and may be saturated and/or unsaturated. Preferred imidazolines include steryl imidazolines, isosteryl imidazolines, and mixtures of steryl imidazolines and isosteryl imidazolines. In general, steryl groups can be characterized as alkyl groups containing 16 to 18 carbon atoms that may be saturated and/or unsaturated. This type of cationic surfactant is believed to be available under the name Monastat from Unichemi.

Another preferred type of cationic surfactant includes alkyl ethoxylated and/or propoxylated quaternary ammonium salts (or amines). Preferably, the alkyl group contains between about 6 and about 24 carbon atoms and can be saturated and/or unsaturated. The degree of ethoxylation is preferably between about 0 and about 30, and the degree of propoxylation is preferably between about 0 and about 30, with the proviso that at least one of the degree of ethoxylation or the degree of propoxylation is at least one. Preferred alkyl ethoxylated quaternary ammonium salts include a degree of ethoxylation of between about 5 and 15. Preferred alkyl propoxylated quaternary ammonium salts include a degree of propoxylation of between about 5 and about 15. A preferred cationic surfactant is commercially available under the name Variquat K1215 from Goldschmidt. The applicants discovered that this cationic surfactant is particularly useful for providing the detergent composition with enhanced water hardness tolerance. Another preferred cationic surfactant is available under the name Varonic K205 from Goldschmidt. The applicants discovered that this cationic surface allows the detergent composition to exhibit enhanced degreasing and enhanced foam quality, and helps enhance water hardness tolerance.

The applicants discovered that water hardness may decrease the ability of the detergent composition to penetrate the soil present on an aluminum surface in order to clean and brighten the aluminum surface. It should be understood that hard water can be characterized as water containing greater than 100 ppm calculated as calcium carbonate. It should be understood that "100 ppm calculated as calcium carbonate" refers to the components within the water that contribute to the hardness although all the components are likely not calcium carbonate. The applicants discovered that certain surfactants can provide the cleaning composition with enhanced water hardness tolerance. Particularly preferred surfactants that enhance the water hardness tolerance of the cleaning composition include the alkyl ethoxylated and/or propoxylated quaternary ammonium salts, and, in particular, the surfactants available under the names Variquat 1215 and Varonic K205 from Goldschmidt.

The cleaning composition preferably includes a mixture of alkyl imidazoline quaternary ammonium salts, and alkyl ethoxylated and/or propoxylated quaternary ammonium salts. Preferably, the mixture is a mixture of Monastat surfactant, Variquat 1215 surfactant, and Varonic K205 surfactant. The weight ratio of each surfactant can be provided as between about 0.1 and about 10 relative to the other surfactant. Preferably, the weight ratio of each of the three surfactants is 1:1.

Amphoteric surfactants that can be used according to the invention as penetrants include those surfactants having the formula:

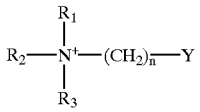

wherein $R_1$, $R_2$, and $R_3$ include, individually, or in combination, substituents including 6 to 24 carbon atoms, preferably 14 to 24 carbon atoms, and more preferably 16 to 24 carbon atoms. Each of $R_1$ to $R_3$ can be linear, cyclic, branched, saturated, or unsaturated, and can include heteroatoms such as oxygen, phosphorous, sulfur, or nitrogen. Any two of $R_1$ to $R_3$ can form a cyclic group. Y is preferably an anionic substituent such as carboxy, phosphorus derivative, sulfate, and sulfonate. Exemplary phosphorus derivatives include phosphate and phosphorus esters. The number of repeating units n can be about 1 to about 20, and preferably 1 to 10, and more preferably 1–3 and most preferably 1. Preferred amphoteric surfactants that can be used according to the invention include betaines, sultaines, imidazoline derivatives, and amine oxides. Preferred amphoteric surfactants include lauramine oxide, cocoamidopropyl betaine, and lauryl amphoacetate.

Anionic surfactants that can be used according to the invention as penetrants include those surfactants having the formula:

wherein R can be a saturated or unsaturated alkyl or aryl or aralkyl substituent including 6 to 24 carbon atoms, preferably 14 to 24 carbon atoms, and more preferably 16 to 24 carbon atoms. The substituent R can be linear, cyclic, branched, saturated, or unsaturated. Y is an anionic substituent that is preferably sulfonate, sulfate, phosphate, carbonate. Exemplary anionic surfactants include tetradecylether sulfate and dodecylbenzene sulfonate.

Nonionic surfactants that can be used according to the invention as penetrants include those surfactants having the formula:

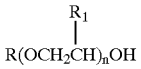

wherein R is a substituent having 1 to 24 carbon atoms, preferably 12 to 20 carbon atoms, and more preferably 15 to 20 carbon atoms. R can be linear, cyclic, branched, saturated, or unsaturated, and can include heteroatoms such as oxygen, phosphorous, sulfur, or nitrogen. $R_1$ is H or $CH_3$, and n is preferably between 1 and 30. Exemplary nonionic surfactants include alcohol ethoxylates, alkylphenol ethoxylates, EO/PO copolymers, and alkanolamides. Preferred nonionic surfactants include nonylphenol ethoxylate and myristeth-7.

The penetrant is preferably provided in an amount sufficient to help the cleaning composition penetrate soil that may be present on the aluminum surface so that the cleaning composition can reach the aluminum surface and clean and brighten the aluminum surface. The penetrant is preferably provided in an amount that provides a use solution containing between about 0.01 wt. % and about 20 wt. % penetrant, more preferably between about 0.1 wt. % and about 10 wt. % penetrant, and, even more preferably, between about 0.5 wt. % and about 5 wt. % penetrant. It should be appreciated that the penetrant is an optional component, and the cleaning composition can be provided without any penetrant.

It is believed that the acid component helps drive a reaction between phosphoric acid and the oxidant component. In one embodiment of the invention, the cleaning composition can be provided as a result of mixing the source of phosphoric acid component, the acid component, the oxidant component, and the penetrant. In an alternative embodiment of the invention, the cleaning composition can be provided as a multi-part system such as a two-part system. In a two-part system, the acid component can be combined with a mixture of the source of phosphoric acid component, the oxidant component, and the penetrant to provide a cleaning composition. The acid component can be provided as a liquid and the cleaning composition can be used as a spray, gel, or foam. In addition, the acid component can be introduced as a solid that dissolves. For example, the acid component can be provided in the form of polymeric beads or resins wherein the acid is covalently bonded to the resin. An exemplary solid acid includes sulfamic acid. It is believed that the cleaning composition would then dissolve the solid acid. In addition, the acid provided on beads can dissolve or it may not dissolve.

The cleaning composition according to the invention is preferably substantially free of hydrofluoric acid. This generally means that the cleaning composition is completely free of hydrofluoric acid, or if hydrofluoric acid is present, it is present in an amount where it presents no substantial health hazard. It is desirable that the presence of hydrofluoric acid need not be declared on packaging for the cleaning composition. It should be understood that the phrase "substantially free of hydrofluoric acid" does not exclude the presence of fluoride anions and/or hydrofluoric acid present as a result of the water being used. It is pointed out that many municipalities fluorinate water, and that at certain pH levels there is an equilibrium relationship between hydrofluoric acid and fluoride anion.

When the cleaning composition is a product of mixing phosphoric acid, hydrogen peroxide, and sulfuric acid, a preferred composition can be described by the equation below where the weight fractions of the components are present in such ratios that the brightening effectiveness is $\geqq 1.5$ on a scale where 0=no brightening, 1=less brightening than commercial HF containing cleaning composition, 2=matches commercial HF containing cleaning composition brightening, 3=better than commercial HF containing cleaning composition brightening, H=wt. % of hydrogen peroxide [35% active basis] in decimal form, S=wt. % of sulfuric acid in decimal form, and P=wt. % of phosphoric acid [75% basis] in decimal form.

$$1.5 \leqq [1.9*H+0.64*S+5.25*H*S-1.17*H*P+2.34*S*P-3.84*H*S*P-4.04*H*S(H-S)+6.85*H*P(H-P)+11.18*S*P(S-P)]$$

A preferred composition corresponding to the above equation is provided by about 1 mole hydrogen peroxide/1 mole phosphoric acid/at least 5 moles sulfuric acid.

The cleaning composition can be provided in the form of a solution, emulsion, microemulsion, suspension, solid, pellets, powder, gel, and foam. The cleaning composition can include an aqueous or nonaqueous solvent. A preferred aqueous solvent is water, which may be added directly to the composition at the manufacturing stage or the composition may be added/injected into a water stream at the point of use to provide a use solution. Water insoluble oils such as mineral oil or spirits, paraffins, methyl soyate, etc., can be optionally added to modify wetting and drying properties. Water insoluble oils are generally considered to be oils that are less than 1 wt. % soluble in water.

The appearance of the cleaning composition can be modified by the addition of thickeners, dyes, fragrances, and other conventional additives used for cleaners. In addition, the cleaning composition can include builders to soften water, anti-redeposition agents, and antimicrobial actives.

The cleaning composition can be prepared by mixing the acid component, the source of phosphoric acid component, and the oxidant component. The components can be mixed together in the presence or absence of any of the additional components identified above. It is generally desirable to provide the cleaning composition at about room temperature. The reaction between the oxidant component and the phosphoric acid component is generally exothermic. Accordingly, the cleaning composition will tend to increase in temperature as the oxidant component and the phosphoric acid component react.

The composition according to the invention can be used as a two component mixture of acidic component (part A) and oxidant component (part B). The acidic component preferably includes a mixture of the phosphoric acid component and the acid component. The two components can be combined prior to use of the cleaning composition. The penetrant can be provided as part of either the acidic components (part A) or the oxidant component (part B) or as a separate component (part C). Although the cleaning composition is preferably prepared from a two-part system, the cleaning composition can be provided as a one-part system.

The cleaning composition according to the invention can be provided as a cleaning composition that is generated in situ. For example, chlorine dioxide can be generated by a variety of routes including hypochlorite/chlorite mixtures, halogen/chlorite mixtures, polyhalide/chlorite mixtures, and acid/chlorite mixtures. Polyhalides such as those described in U.S. patent application Ser. Nos. 09/277,592 and 09/277,626 can be generated via reaction between an oxidant, a halide source, and a material selected from inorganic halide or quaternary ammonium/phosphonium/sulfonium salts. Peroxyphosphoric acids can be obtained by oxidation of phosphoric or polyphosphoric acid in the presence of a strong acid. Peroxysulfuric acids can also be prepared by reaction of an oxidant with sulfuric acid. The entire disclosures of U.S. patent application Ser. Nos. 09/277,592 and 09/277,626 are incorporated herein by reference.

A method of brightening aluminum with the cleaning composition includes a step of treating either a precleaned or soiled aluminum surface with the cleaning composition, waiting a sufficient period of time for the brightening to occur, and then removing the cleaning composition from the surface. The cleaning composition can be applied to the aluminum surface by spraying or the aluminum can be dipped or soaked in a cleaning solution reservoir. The cleaning solution reservoir can be mechanically agitated. The spray can be as the concentrate or diluted into an aqueous or nonaqueous medium. The nonaqueous medium can be either a liquid with a boiling point above ambient temperature or as a liquefied gas. Examples of liquefied gas include carbon dioxide, air, oxygen, helium, and nitrogen.

The aluminum surface could be part of a motorized vehicle such as a car, truck, boat, ship, plane, jet, helicopter, or train. It could also be part of a fabricated article such as piping, storage tanks, cookware, medical device or a can. It could also be part of an architectural structure such as window parts, door parts, window/door screens, and blinds. Additionally, it could also be part of an electronic device such as a circuit board, computer chip, heat sink, light ballast, or even wiring itself.

EXAMPLE 1

Several cleaning compositions were tested for their effectiveness in cleaning an aluminum surface on commercial trucks in a commercial truck wash facility. The tested cleaning compositions and the test results are reported in Table 1.

The cleaning compositions were evaluated based on their relative ability to brighten an aluminum rail provided on a semi-trailer. The aluminum rail was divided into section with tape separating each section, and various cleaning compositions were sprayed on the different sections. The cleaning compositions were ranked on a scale of 1 to 3+ in comparison with a commercially available hydrofluoric acid containing cleaning composition. The commercially available hydrofluoric acid containing cleaning composition is available under the name Aluminum Cleaner & Brightener from Ecolab, Inc. 1 means the cleaning composition had some cleaning activity but less activity than the control. 2 means the cleaning composition matched the cleaning activity of the control. 3 means that the cleaning composition had better cleaning activity than the control. 3+ means that the cleaning composition had outstanding cleaning activity.

The cleaning compositions tested are reported in Table 1. The base composition was prepared by mixing 75 wt. % concentrated sulfuric acid, 13 wt. % phosphoric acid (75% active), and 12 wt. % hydrogen peroxide (35% active). The base composition was provided as a 5 wt. % use solution. Several additional compositions were tested by adding a penetrant to the base composition. The amount of penetrant and the particular penetrant for each composition is identified in Table 1. The microemulsion is a mixture of 12 wt. % mineral oil, 20.4 wt. % alkyl polyglucoside available under the name Glucopon 625 from Henkel, 20.4 wt. % alcohol ethoxylate available under the name Surfonic 24-5 from Huntsman Chemical, and remainder water. The component identified as Monastat 1195 is available from Unichemi. The component identified as Miranol/2CM-SF is an amphoteric surfactant available from Miranol. The component identified as Alkamide DC212/M is an alkylamide. The component identified as Monazoline 0 is an imidazoline salt available from Unichemi. The component identified as "Deterg. Comp." is a mixture containing nonylphenol ethoxylates and amphoteric surfactant. The component identified as NPE blend is a mixture of 50 wt. % nonylphenol ethoxylate containing 9.5 EO and 50 wt. % nonylphenol ethoxylate containing 4.5 EO. The component identified as NPE/Glensurf 42 is a mixture of 50 wt. % nonylphenol ethoxylate containing 9.5 EO and 50 wt. % propoxylated quaternary ammonium salt from Glen Chemical. The component identified as NPE/Monastat 1195 is a blend of 50 wt. % nonylphenol ethoxylate containing 9.5 EO and 50 wt. % Monastat 1195.

TABLE 1

Comparison of Aluminum Cleaning Compositions at Commercial Truckwash Facility

| Approx. Metal Temp. (° F.) | Cleaning Composition | # of Treatments | Exposure Time (min.) | Concentration (Wt %) | Brightening |
|---|---|---|---|---|---|
| 40 | Aluminum Cleaner & Brightener | 1 | 2 | 3.0 | 2 |
| 40 | 5% [8 $H_2SO_4$/1 $H_3PO_4$/1 $H_2O_2$] | 1 | 2 | 5.0 | 1 |
| 40 | 5% [8 $H_2SO_4$/1 $H_3PO_4$/1 $H_2O_2$] 1% microemulsion | 1 | 2 | 6.0 | 2 |
| 40 | 5% [8 $H_2SO_4$/1 $H_3PO_4$/1 $H_2O_2$] 1% Monastat 1195 | 1 | 2 | 6.0 | 3 |
| 40 | Aluminum Cleaner & Brightener | 1 | 10 | 3.0 | 2 |
| 40 | 5% [8 $H_2SO_4$/1 $H_3PO_4$/1 $H_2O_2$] 1% Monastat 1195 | 1 | 10 | 6.0 | 3 |
| 40 | Aluminum Cleaner & Brightener | 2 | 2 | 5.0 | 2 |
| 40 | 5% [8 $H_2SO_4$/1 $H_3PO_4$/1 $H_2O_2$] 1% microemulsion | 2 | 2 | 6.0 | 3+ |
| 60 | 5% [6 $H_2SO_4$/1 $H_3PO_4$] | 1 | 2 | 5.0 | 1 |
| 60 | 5% [8 $H_2SO_4$/1 $H_3PO_4$/1 $H_2O_2$] | 1 | 2 | 5.0 | 1 |
| 60 | 5% [8 $H_2SO_4$/1 $H_3PO_4$/1 $H_2O_2$] 1% Monastat 1195 | 1 | 2 | 6.0 | 3+ |
| 60 | 5% [8 $H_2SO_4$/1 $H_3PO_4$/1 $H_2O_2$] 1% Miranol 2CM-SF | 1 | 2 | 6.0 | 3 |
| 60 | 5% [8 $H_2SO_4$/1 $H_3PO_4$/1 $H_2O_2$] 1% Miranol CM-SF | 1 | 2 | 6.0 | 3 |
| 60 | 5% [8 $H_2SO_4$/1 $H_3PO_4$/1 $H_2O_2$] 1% Alkamide DC212/M | 1 | 2 | 6.0 | 4 |
| 60 | 5% [8 $H_2SO_4$/1 $H_3PO_4$/1 $H_2O_2$] 1% Monazoline O | 1 | 2 | 6.0 | 3+ |
| 70 | 5% [8 $H_2SO_4$/1 $H_3PO_4$/l $H_2O_2$] 1% Monastat 1195 | 1 | 2 | 6.0 | 3 |
| 70 | 5% [8 $H_2SO_4$/1 $H_3PO_4$/1 $H_2O_2$] 0.1% Monastat 1195 | 1 | 2 | 5.1 | 3 |
| 70 | 5% [8 $H_2SO_4$/1 $H_3PO_4$/1 $H_2O_2$] 1% deterg. comp. | 1 | 2 | 6.0 | 1 |
| 70 | 5% [8 $H_2SO_4$/1 $H_3PO_4$/1 $H_2O_2$] 1% NPE blend | 1 | 2 | 6.0 | 1 |
| 70 | 5% [8 $H_2SO_4$/1 $H_3PO_4$/1 $H_2O_2$] 1% NPE/Glensurf 42 | 1 | 2 | 6.0 | 1 |
| 70 | 5% [8 $H_2SO_4$/1 $H_3PO_4$/1 $H_2O_2$] 1% NPE/Monastat 1195 | 1 | 2 | 6.0 | 1 |
| 70 | 5% [8 $H_2SO_4$/1 $H_3PO_4$/1 $H_2O_2$] 0.1% Monastat 1195 | 1 | 2 | 3.1 | 3 |

EXAMPLE 2

Several cleaning compositions were compared according to the criteria described in Example 1. The cleaning compositions differed in the acid component. The cleaning compositions included a molar ratio of 1 mole hydrogen peroxide to 1 mole phosphoric acid to 7.7 mole of the acid component identified in Table 2. The cleaning compositions were allowed to contact an aluminum surface for one minute at ambient temperature. The results of this test are reporting in Table 2.

TABLE 2

| Acid | Brightening | pKa |
|---|---|---|
| phosphoric | 2 | 2.5 |
| sulfuric | 3 | <2.5 |
| hydrochloric | 3 | <2.5 |
| acetic | 1 | >2.5 |

EXAMPLE 3

Cleaning compositions were compared using the criteria identified in Example 1. The oxidant component was varied and the results of the test are reported in Table 3. The for one minute at ambient temperature.

TABLE 3

| Oxidant | Brightening |
|---|---|
| $H_2O_2$ | 3 |
| $H_2O_2$/POAA | 3 |
| Na iodate | 3 |

EXAMPLE 4

Several cleaning compositions were compared under the criteria. The amount of phosphoric acid, sulfuric acid, and hydrogen peroxide were varied. The cleaning compositions were applied to an aluminum surface for one minute at ambient temperature. The hydrogen peroxide was provided as a 5% solution of 35% active hydrogen peroxide. The sulfuric acid was provided as a 5% solution of concentrate sulfuric acid. The phosphoric acid was provided as a 5% solution of 75% active phosphoric acid. The composition of each cleaning composition and the test results are reported in Table 4.

The "brightening score" reflects the observed degree of brightening provided by the cleaning composition. A value cleaning composition included 1 mole oxidant to 1 mole phosphoric acid to 7.7 moles sulfuric acid. The cleaning composition was allowed to contact the aluminum surface of 0 reflects no observed brightening. A value of one reflects some brightening but less than the brightening exhibited by the control. A value of two represents brightening matching the brightening of the control. A value of three represents better brightening than the brightening exhibited by the control. The control is a 1 wt. % composition of Presoak 690 that contains hydrofluoric acid. Presoak 690 is commercially available from Ecolab Inc.

TABLE 4

| Weight Ratio | | | | Molar Ratio | | |
|---|---|---|---|---|---|---|
| 5% soln of 35% H2O2 | 5% soln of conc. Sulfuric acid | 5% soln of 75% phosphoric acid | Brightening Score | H2O2 | sulfuric acid | phosphoric acid |
| 100 | 0 | 0 | 0 | 1.0 | 0.0 | 0.0 |
| 75 | 25 | 0 | 2 | 3.0 | 1.0 | 0.0 |
| 50 | 50 | 0 | 2 | 1.0 | 1.0 | 0.0 |
| 25 | 75 | 0 | 2 | 1.0 | 2.9 | 0.0 |
| 0 | 100 | 0 | 2 | 0.0 | 1.0 | 0.0 |
| 75 | 0 | 25 | 2 | 3.9 | 0.0 | 1.0 |
| 50 | 0 | 50 | 1 | 1.4 | 0.0 | 1.0 |
| 25 | 0 | 75 | 1 | 1.0 | 0.0 | 2.2 |
| 0 | 75 | 25 | 2 | 0.0 | 3.8 | 1.0 |
| 0 | 50 | 50 | 2 | 0.0 | 1.3 | 1.0 |
| 0 | 25 | 75 | 1 | 0.0 | 1.0 | 2.2 |
| 0 | 0 | 100 | 2 | 0.0 | 0.0 | 1.0 |
| 25 | 25 | 50 | 2 | 1.0 | 1.0 | 1.5 |
| 25 | 50 | 25 | 2 | 1.3 | 2.6 | 1.0 |
| 50 | 25 | 25 | 1 | 2.6 | 1.3 | 1.0 |
| 75 | 12 | 13 | 1 | 7.7 | 1.2 | 1.0 |
| 12 | 75 | 13 | 3 | 1.2 | 7.7 | 1.0 |
| 12 | 13 | 75 | 0 | 1.0 | 1.1 | 4.8 |
| 33 | 33 | 34 | 2 | 1.3 | 1.3 | 1.0 |

EXAMPLE 5

The cleaning compositions containing 1 wt. % penetrant were compared with a control. The penetrants tested are identified in Table 5. The cleaning compositions were exposed to an aluminum rail for two minutes at ambient temperature. The amount of brightening is reported in Table 5. The brightening was evaluated compared with the brightening exhibited by a commercially available hydrofluoric acid containing composition available under the name Presoak 690. A value of one represents some brightening. A value of two represents brightening matching the control. A value of three represents better brightening than the control. A value of 3+ represents extraordinary brightening compared to the control.

TABLE 5

| Additive Tradename | Additive Chemical Name | | Brightening |
|---|---|---|---|
| | Control | | 2 |
| Overdrive Surfactants | NPE/R-EO-PO/LAS/Quat-PO | nonionic/cationic | 2 |
| Mirataine ASC | alkyletherhydroxypropyl sultaine | anionic | 2 |
| FMB-AO12 | lauramine oxide | amphoteric | 2 |
| Bardac 2250 | didecyldimethylammonium chloride | cationic | 2 |
| Larostat 451 | alkyldimethylbenzyl-ammonium chloride | cationic | 2 |
| Varonic K-205 | ethoxylated coco amine | nonionic | 2 |
| Aquasure 6004 | polymeric quat | cationic | 2 |
| Magnifloc 581C | polymeric quat | cationic | 2 |
| Monastat 1195 | isosteryl and steryl imidazoline derivative | cationic | 3 |
| Miranol CM-SF | Na cocoampho propionate | amphoteric | 3 |

TABLE 5-continued

| Additive Tradename | Additive Chemical Name | | Brightening |
|---|---|---|---|
| Miratain TM | dihydroxyethyltallow glycinate | amphoteric | 3 |
| Miratain T2C | di-Na tallowimino dipropionate | amphoteric | 3 |
| Monateric T-C6 | Na dicarboxylethylphospho-ethyl imidazoline | amphoteric | 3 |
| Monazoline O | oleylhydroxyethyl imidazoline | cationic | 3+ |
| Monateric CSH-32 | cocoampho diacetate | amphoteric | 3+ |
| Alkamide WRS-1666 | oleic diethanolamide | nonionic (pH cation | 3+ |
| Miranol FBS [CEM] | di-Na cocoampho dipropionate | amphoteric | 3+ |
| Alkamide DC-212/M | coco diethanolamide | nonionic (pH cationic) | 3+ |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A cleaning composition comprising:

(a) a product of mixing:

(i) acid component comprising at least one of sulfuric acid, hydrochloric acid, hydrobroznic acid, hydroiodic acid, imidophosphoric acid, thiocyanic acid, and mixtures thereof, wherein said acid component does not include nitric acid;

(ii) source of phosphoric acid component to provide phosphoric acid;

(iii) oxidant component, wherein the oxidant component comprises at least one of hydrogen peroxide, adducts of hydrogen peroxide, peroxycarboxylic acid, salts of peroxycarboxylic acid, pertungstic acid, permanganates, ozone, halogens, halogenoxides, manganese compounds, chromium compounds, cerium compounds, vanadium compounds, copper compounds, silver compounds, iron compounds, titanium compounds, and mixtures thereof, wherein the molar ratio of the oxidant component to the phosphoric acid is between about 2:1 and about 1:2; and (iv) penetrant comprising a cationic s t having the formula:

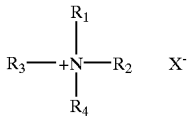

wherein each of $R_1$, $R_2$, $R_3$, and $R_4$ include, individually, or in combination, substituents including 6 to 24 carbon atoms, any one to tee of $R_1$, $R_2$, and $R_4$ can be hydrogen, and X is a counter ion.

2. A cleaning composition according to claim 1, wherein the molar ratio of oxidant component to acid component is between about 1:3 and about 1:5.

3. A cleaning composition according to claim 1, wherein the source of phosphoric acid component comprises at least one of phosphoric acid, polyphosphoric acid, oxides of phosphorus, and mixtures thereof.

4. A cleaning composition according to claim 1, wherein the source of phosphoric acid component comprises an oxide of phosphorus comprising at least one of phosphorus tetraoxide, phosphorus hexaoxide, phosphorus decaoxide, and mixtures thereof.

5. A cleaning composition according to claim 1, wherein the source of phosphoric acid component comprises phosphoric acid.

6. A cleaning composition according to claim 1, comprising:

(a) about 0.01 wt. % to about 20 wt. % of the penetrant.

7. A cleaning composition according to claim 6, wherein the penetrant comprises an alkyl imidazoline quaternary ammonium salt, wherein the alkyl group contains between about 6 and about 24 carbon atoms and can be saturated and/or unsaturated.

8. A cleaning composition according to claim 6, wherein the penetrant comprises an alkyl ethoxylated and/or propoxylated quaternary ammonium salt, wherein the alkyl group contains between about 6 and about 24 carbon atoms, and the degree of ethoxylation is between about 0 and about 30, and the degree of propoxylation is between about 0 and about 30, with the proviso that at least one of the degree of ethoxylation or the degree of propoxylation is at least one.

9. A cleaning composition according to claim 6, wherein the penetrant comprises an amphoteric surfactant having the formula:

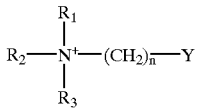

wherein $R_1$, $R_2$, and $R_3$ include, individually or in combination, substituents including 6 to 24 carbon atoms, Y is an anionic substituent, and n is 1 to 20.

10. A cleaning composition according to claim 6, wherein the penetrant further comprises an anionic surfactant having the formula:

wherein R can be a saturated or unsaturated alkyl or aryl or aralkyl substituent including 6 to 24 carbon atoms, and Y is an anionic substituent.

11. A cleaning composition according to claim 6, wherein the penetrant comprises a nonionic surfactant having the formula:

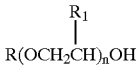

wherein R is a substituent having 1 to 24 carbon atoms, R, is H or $CH_3$, and n is 1 to 30.

12. A cleaning composition according to claim 1, wherein the cleaning composition comprises a use solution comprising about 0.1 wt. % to about 20 wt. % of the combination of the acid component, the phosphoric acid, and the oxidant component.

13. A method for cleaning an aluminum surface, the method comprising the steps of:

applying a cleaning composition to an aluminum surface, the cleaning composition comprising a product of mixing:

(i) acid component comprising at least one of sulfuric acid, hydrochloric acid, hydrobromic acid, hydroiodic acid, imidophosphoric acid, thiocyanic acid, and mixtures thereof, wherein said acid component dots not include nitric acid;

(ii) source of phosphoric acid component to provide phosphoric acid;

(iii) oxidant component, wherein the oxidant component comprises at least one of hydrogen peroxide, adducts of hydrogen peroxide, peroxycarboxylic acid, salts of peroxycarboxylic acid, pertungstic acid, permanganates, ozone, halogens, halogenoxides, manganese compounds, chromium compounds, cerium compounds, vanadium compounds, copper compounds, silver compounds, iron compounds, titanium compounds, and mixtures thereof, wherein the molar ratio of the oxidant component to the phosphoric acid is between about 2:1 and about 1:2;

(iv) penetrant comprising a cationic surfactant having the formula:

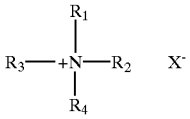

wherein each of $R_1$, $R_2$, $R_3$, and $R_4$ include, individually, or in combination, substituents including 6 to 24 carbon atoms, any one to three of $R_1$, $R_2$, $R_3$, and $R_4$ can be hydrogen, and X is a counter ion; and rinsing the cleaning composition from the aluminum surface.

14. A method according to claim 13, wherein the molar ratio of oxidant component to acid component is between about 1:3 and about 1:5.

15. A method according to claim 13, wherein the source of phosphoric acid component comprises at least one of phosphoric acid, polyphosphoric acid, oxides of phosphorus, and mixtures thereof.

16. A method according to claim 13, wherein the source of phosphoric acid component comprises an oxide of phosphorus comprising at least one of phosphorus tetraoxide, phosphorus hexaoxide, phosphorus decaoxide, and mixtures thereof.

17. A method according to claim 13, wherein the source of phosphoric acid component comprises phosphoric acid.

18. A method according to claim 13, wherein the composition comprises:

(a) about 0.01 wt. % to about 20 wt. % of the penetrant.

19. A method according to claim 18, wherein the penetrant comprises an alkyl imidazoline quaternary ammonium salt, wherein the alkyl group contains between about 6 and about 24 carbon atoms and can be saturated and/or unsaturated.

20. A method according to claim 18, wherein the penetrant comprises an alkyl ethoxylated and/or propoxylated quaternary ammonium salt, wherein the alkyl group contains between about 6 and about 24 carbon atoms, and the degree of ethoxylation is between about 0 and about 30, and the degree of propoxylation is between about 0 and about 30, with the proviso that at least one of the degree of ethoxylation or the degree of propoxylation is at least one.

21. A method according to claim 18, wherein the penetrant comprises an amphoteric surfactant having the formula:

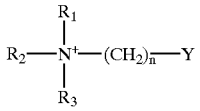

wherein $R_1$, $R_2$, and $R_3$ include, individually or in combination, substituents including 6 to 24 carbon atoms, Y is an anionic substituent, and n is 1 to 20.

22. A method according to claim 18, wherein the penetrant further comprises an anionic surfactant having the formula:

wherein R can be a saturated or unsaturated alkyl or aryl or aralkyl substituent including 6 to 24 carbon atoms, and Y is an anionic substituent.

23. A method according to claim 18, wherein the penetrant further comprises a nonionic surfactant having the formula:

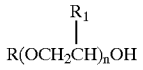

wherein R is a substituent having 1 to 24 carbon atoms, $R_1$ is H or $CH_3$, and n is 1 to 30.

24. A method according to claim 18, wherein the cleaning composition comprises a use solution comprising about 0.1 wt. % to about 20 wt. % of the combination of the acid component, the phosphoric acid, and the oxidant component.

25. A method according to claim 13, wherein the cleaning composition comprises water having a water hardness level of greater than 100 ppm calculated as calcium carbonate.

26. A method according to claim 13, wherein the step of applying a cleaning composition to an aluminum surface comprises spraying a foam cleaning composition to an aluminum surface.

27. A method for manufacturing a cleaning composition for cleaning an aluminum surface, the method comprising:

mixing:

(i) acid component comprising at least one of sulfuric acid, hydrochloric acid, hydrobromic acid, hydroiodic acid, imidophosphoric acid, thiocyanic acid, and mixtures thereof, wherein said acid component does not include nitric acid;

(ii) source of phosphoric acid component to provide phosphoric acid;

(iii) oxidant component, wherein the oxidant component comprises at least one of hydrogen peroxide, adducts of hydrogen peroxide, peroxycarboxylic acid, salts of peroxycarboxylic acid, pertungstic acid, permanganates, ozone, halogens, halogenoxides, manganese compounds, chromium compounds, cerium compounds, vanadium compounds, copper compounds, silver compounds, iron compounds, titanium compounds, and mixtures thereof, wherein the molar ratio of the oxidant component to the phosphoric acid is between about 2:1 and about 1:2; and (iv) penetrant comprising a cationic surfactant having the formula:

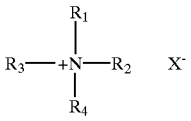

wherein each of $R_1$, $R_2$, R3, and $R_4$ include, individually, or in combination, substituents including 6 to 24 carbon atoms, any one to three of $R_1$, $R_2$, $R_3$, and $_{4R}$ can be hydrogen, and X is a counter ion.

28. A cleaning composition according to claim 1, wherein the oxidant component comprises hydrogen peroxide.

29. A method for cleaning according to claim 13, wherein the oxidant component comprises hydrogen peroxide.

30. A method according to claim 27, wherein the oxidant component comprises hydrogen peroxide.

* * * * *

UNITED STATES PATENT AND TRADEMARK OFFICE

CERTIFICATE OF CORRECTION

PATENT NO. : 6,489,281 B1
DATED : December 3, 2002
INVENTOR(S) : Smith et al.

It is certified that error appears in the above-identified patent and that said Letters Patent is hereby corrected as shown below:

Column 4,
Line 56, "Variquat K1215" should read -- Variquat 1215 --

Column 12,
Line 62, "hydrobroznic" should read -- hydrobromic --

Column 13,
Line 13, "cationic s t having" should read -- cationic surfactant having --
Lines 23-24, "to tee of $R_1$, $R_2$, and $R_4$" should read -- to three of $R_1$, $R_2$, $R_3$ and $R_4$ --

Column 14,
Line 17, "atoms, R," should read -- atoms, $R_1$, --
Line 33, "dots" should read -- does --
Line 46, "R3," should read -- $R_3$, --
Line 49, "$_{4R}$" should read -- $R_4$ --

Signed and Sealed this

Ninth Day of September, 2003

JAMES E. ROGAN
*Director of the United States Patent and Trademark Office*